United States Patent [19]

Shillady

[11] 4,365,214

[45] Dec. 21, 1982

[54] SEMICONDUCTOR MOUNTING AND MATCHING ASSEMBLY

[75] Inventor: Robert W. Shillady, North Wales, Pa.

[73] Assignee: American Electronic Laboratories, Inc., Colmar, Pa.

[21] Appl. No.: 190,464

[22] Filed: Sep. 24, 1980

[51] Int. Cl.[3] ..... H01P 5/08

[52] U.S. Cl. ..... 333/33; 333/245

[58] Field of Search ..... 333/245, 247, 262, 22 R, 333/33; 329/162

[56] References Cited

U.S. PATENT DOCUMENTS

| | | | |
|---|---|---|---|
| 2,432,097 | 12/1947 | Hewitt, Jr. . | |
| 2,555,151 | 5/1951 | Noyes, Jr. | 329/162 |
| 2,810,829 | 10/1957 | Schrock . | |
| 3,010,072 | 11/1961 | DeBroekert et al. | 329/162 |
| 3,212,015 | 10/1965 | Kruse, Jr. . | |
| 3,437,960 | 4/1969 | Ziegler, Jr. . | |
| 3,460,072 | 8/1969 | Ziegler, Jr. | 333/33 |
| 3,492,605 | 1/1970 | Ziegler, Jr. . | |
| 3,656,072 | 4/1972 | Ludwig et al. . | |
| 3,681,718 | 8/1972 | Kozul et al. | 333/245 |
| 3,916,350 | 10/1975 | Swan | 333/262 X |

OTHER PUBLICATIONS

"Synthesis of Mixed Lumped and Distributed Impedance-Transforming Filters", by Ralph Levy, IEEE Transactions on Microwave Theory and Techniques, vol. MTT-20, No. 3, Mar. 1972, pp. 223 to 233.

"Coaxial Line Discontinuities", Proceedings of the I.R.E., vol. 32, Nov. 1949, pp. 695 to 709.

"Microwave Filters, Impedance-Matching Networks, and Coupling Structures", by Matthaei et al., McGraw-Hill Book Co., New York, 1964, pp. 360 to 370.

"The Packaged and Mounted Diode as a Microwave Circuit", by William J. Getsinger, IEEE Transactions on Microwave Theory and Techniques, vol. MTT-14, No. 2, Feb. 1966, pp. 58 to 69.

*Primary Examiner*—Paul L. Gensler

*Attorney, Agent, or Firm*—Jacob Trachtman

[57] ABSTRACT

A semiconductor mounting and matching assembly capable of performing over a frequency range to 20 GHz and higher comprising a coaxial transmission line having a first portion with a first end for receiving radio-frequency signals and providing an input impedance and a second portion with a second signal output end providing a termination characteristic impedance. A semiconductor diode which is hermetically sealed within and removable with the second portion is mounted at the second end and has a load resistance terminating the transmission line. The transmission line has a plurality of sections for providing elements of a network which transforms the input impedance and matches the termination characteristic impedance of the second end of the transmission line to the load resistance of the semiconductor device. The elements of the network are provided by the configurations and discontinuities of the sections of the transmission line and the capacitive and inductive properties provided by the semiconductor device, whereby the network incorporates therein the parasitic reaction elements of the semiconductor device so that said assembly transmits radio-frequency signals from its input end to the semiconductor device at its output end with low reflection and attenuation over a wide-band of frequencies.

30 Claims, 6 Drawing Figures

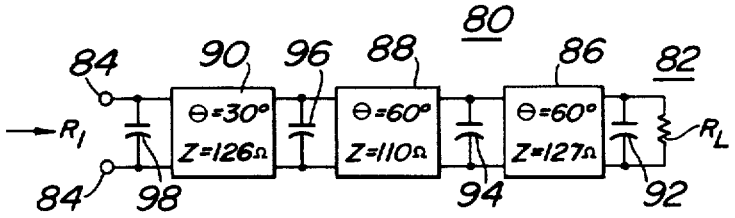
FIG. 3
FIG. 5
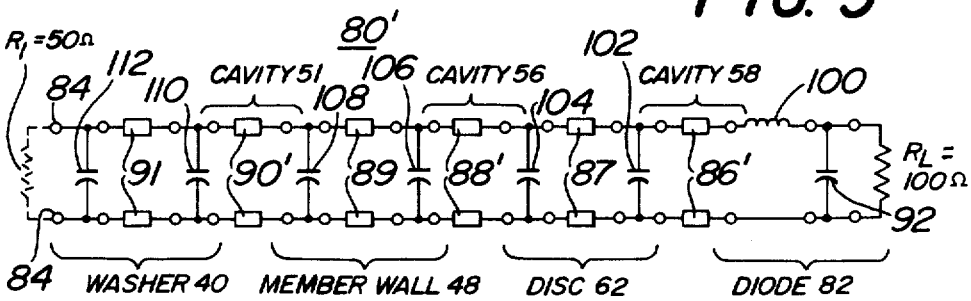
FIG. 6
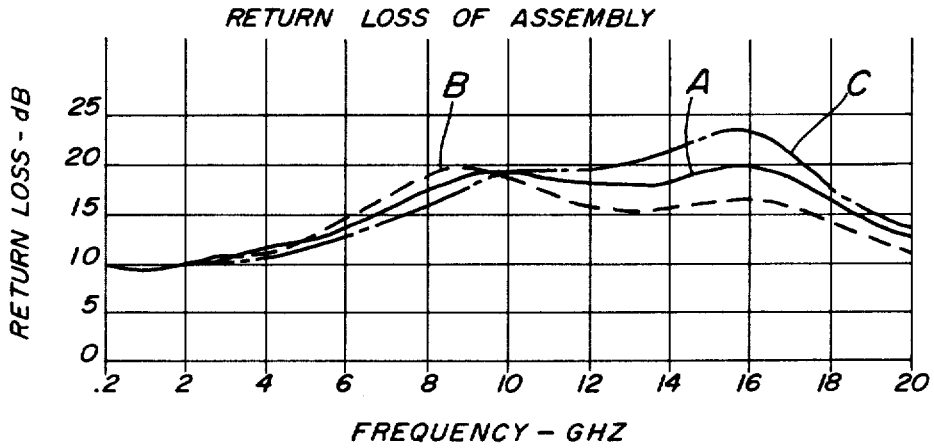

SEMICONDUCTOR MOUNTING AND MATCHING ASSEMBLY

The invention relates to a semiconductor mounting and matching assembly, and more particularly to a semiconductor mounting and matching assembly providing low reflection and attenuation of input signals over a wide-band of frequencies.

BACKGROUND OF THE INVENTION

Currently produced semiconductor mounting and matching structures utilize costly precision assembly techniques for providing high sensitivities to input signals over only a limited range of frequencies. In such assemblies, the semiconductor devices are internally embedded in the impedance transforming structure preventing field replacement, thus making repair very costly, and generally resulting in loss of the assembly upon the failure of the semiconductor device. Other structures such as those provided with diode modules, generally include components within the modules which are semi-lumped resulting in a quasi-TEM mode of signal transmission. This mode of transmission leads to non-ideal behavior of the assembly which behavior is characterized by performance which degrades with increasing signal frequency.

Prior to current designs, packaged diodes were utilized. Such packages possessed parasitic reactive elements which when combined with the parasitic elements of the diode, severely restricted the operating bandwidth. The utilization of such diode packages also generally required the tuning of the assembly after replacement and restricted their use to narrow band applications. For wide-band applications, prior art devices have utilized resistive components in series with the diodes, resulting in loss of sensitivity.

SUMMARY OF THE INVENTION

To overcome the above disadvantages, the present invention provides a semiconductor mounting and matching assembly achieving wide-band operation with high sensitivity, and which includes a hermetically sealed portion containing a semiconductor device which may readily be replaced for removing a defective semiconductor device, without requiring tuning or other adjustment to the assembly.

A principal object of the invention, therefore, is to provide a new and improved semiconductor mounting and matching assembly allowing operation over a wide-band of frequencies ranging to 20 GHz and higher with low reflection and attenuation of the input signals.

Another object of the invention is to provide a new and improved semiconductor mounting and matching assembly having a portion including a semiconductor device which may readily be replaced without requiring tuning or other adjustment to the assembly.

Another object of the invention is to provide a new and improved semiconductor mounting and matching assembly transmitting input signals principally in the TEM mode with an improved voltage standing wave ratio (VSWR) performance and increased sensitivity.

Another object of the invention is to provide a new and improved semiconductor mounting and matching assembly including a detachable portion containing a hermetically sealed semiconductor device allowing a defective semiconductor device to be readily replaced in the field.

Another object of the invention is to provide a new and improved semiconductor mounting and matching assembly utilizing a coaxial cable with a plurality of sections for transforming and matching the input impedance to the load resistance of a semiconductor device and incorporating the parasitic reactive elements of the semiconductor device for achieving wide-band operation with low reflection and attenuation of the input signals.

Another object of the invention is to provide a new and improved semiconductor mounting and matching assembly for a semiconductor diode utilizing a coaxial transmission line for impedance matching and incorporating the parasitic reactive elements of the diode into the transformation impedance network to provide operation over a wide-band of frequencies with high sensitivity for detection of the input signals.

Another object of the invention is to provide a new and improved semiconductor mounting and matching assembly which can be efficiently produced at a cost which is competitive with state of the art devices.

The above objects as well as many other objects of the invention are achieved by providing a semiconductor mounting and matching assembly comprising a radio-frequency transmission line operating principally in the TEM mode having a first end for receiving radio-frequency input signals and providing an input characteristic impedance matched with the source of input signals, and a second signal output end providing a termination characteristic impedance. A semiconductor device is mounted at the second end of the transmission line and has a load resistance terminating the transmission line with its characteristic impedance.

The transmission line has a plurality of sections for providing the elements of a network transforming the input impedance at the first end of the transmission line to a termination characteristic impedance at the second end which has a value matching the load resistance of the semiconductor device. The elements of the transforming network are provided by the configurations and discontinuities of the sections of the transmission line and the capacitive and inductive properties provided by the semiconductor device. In this manner, the network incorporates therein, the parasitic reactive elements such as the junction capacitance and bonding inductance of the semiconductor device, so that the assembly transmits radio-frequency signals from its input end to the semiconductor device at its output end with low reflection and attenuation over a wide-band of frequencies.

The transmission line which preferably is a coaxial transmission line with outer and inner conductors, is configured along its length to provide relatively long sections alternating with relatively short sections. The short sections have the outer conductor closely spaced to the inner conductor to provide low impedance and effectively lumped shunt capacitive components of the network, while the relatively long sections have the outer conductor less closely spaced to the inner conductor to provide a higher impedance and effectively series inductive components of the network.

A closure means includes an end member secured proximate to the second end of the transmission line, and a wall of dielectric material within a section of the transmission line to provide a sealed chamber within which the semiconductor device is hermetically enclosed. The dielectric wall of the closure means extends between the outer conductor and the inner conductor of a short section of the transmission line to provide the sealed chamber, and the sealed chamber includes the cavity provided by a long section which is enclosed at one end by the dielectric wall in the short section of the transmission line and has the semiconductor device at its other end. The configuration of the outer conductor of the short section is adjusted for the effect of the dielectric material of the wall to provide a desired capacitive component of the network.

The mounting and matching assembly has first and second interengaged portions which are detachably secured. The first portion includes the first end of the transmission line, while the second portion includes the second end of the transmission line and the semiconductor device. The first portion of the assembly also includes connecting means for attachment to a signal source for providing radio-frequency signals to the first end of the transmission line, and connecting means for delivering a bias energization to the semiconductor device for proper operation and for receiving output signals provided by the semiconductor device. The second portion can be detached from and reengaged with the first portion to allow replacement by another second portion with the semiconductor device hermetically sealed therewithin.

BRIEF DESCRIPTION OF THE DRAWING

The foregoing and other objects of the invention will become more apparent as the following detailed description of the invention is read in conjunction with the drawing, in which:

FIG. 3 is a schematic diagram illustrating the generalized components of an impedance transforming network of the assembly shown in FIG. 1, FIG. 4 graphically illustrates the insertion loss characteristic as a function of frequency for the impedance transforming network of FIG. 3, FIG. 5 is a schematic diagram illustrating in greater detail the effective electrical components of the impedance transforming network provided by the structure of the assembly shown in FIG. 1, and FIG. 6 graphically illustrates the return loss characteristics for respective semiconductor mounting and matching assemblies incorporating semiconductor diodes with specified junction capacities for a range of frequencies up to 20 GHz.

Like reference numerals designate like parts throughout the several views.

DETAILED DESCRIPTION

Figure 1:
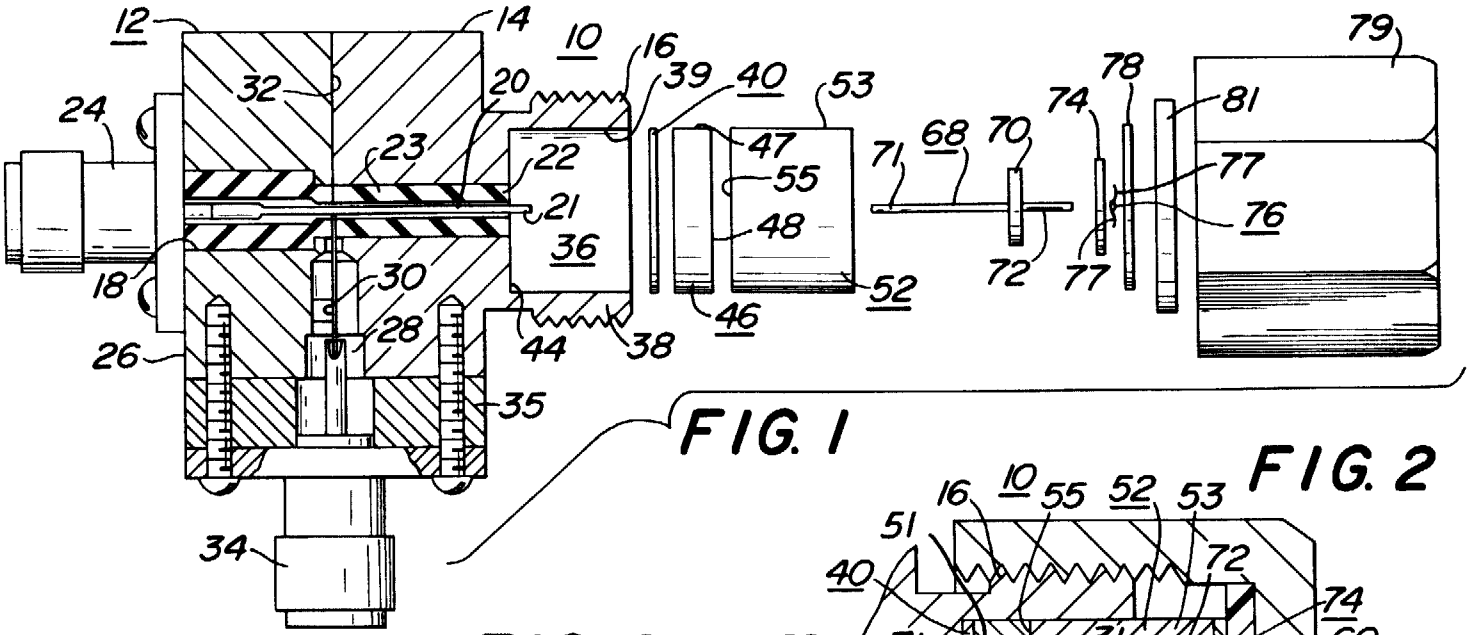
FIG. 1 is a partially exploded view with a portion in section of a semiconductor mounting and matching assembly embodying the invention.
Figure 2:
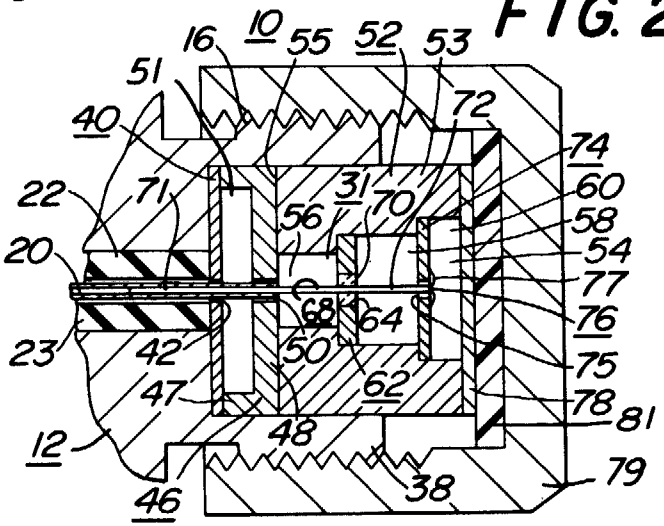
FIG. 2 is an enlarged sectional view of a portion of the assembly shown in FIG. 1 illustrating the coaxial transmission line providing the impedance transforming network, and the semiconductor diode mounted and sealed within the detachable portion thereof.

Refer to the figures, and particularly to FIGS. 1 and 2, which illustrate a semiconductor mounting and matching assembly 10 embodying the invention. The assembly 10 has a housing 12 of a conductive material such as beryllium copper with an enlarged substantially cylindrical portion 14 and a substantially cylindrical portion 16 of reduced size extending coaxially therefrom. The portion 14 of the housing 12 has an axially extending opening 18 therethrough containing therealong an inner or center conductor 20 surrounded by a dielectric material 22 to provide a coaxial signal conducting portion 23. A coaxial signal connector 24 is secured with the left end surface 26 of the housing 12 for connecting the semiconductor mounting and matching assembly 10 with a source of radio-frequency signals.

The portion 14 of the housing 12 may be made of two parts which are separable along transverse partition surfaces 32 for facilitating manufacture and assembly of the housing 12 and its components. Along the partition surfaces 32, the bottom of the portion 14 of the housing 12 has a second opening 28 extending upwardly to transversely meet the opening 18. The opening 28 is also provided with an inner or center conductor 30 which at its inner end electrically engages the center conductor 20. A coaxial connector 34 and adaptor 35 with an opening therethrough aligned with the opening 28 are secured at the bottom of the portion 14 of the housing 12. The connector 34 is joined with the center conductor 30 at its outer end to provide a high impedance input for a semiconductor biasing signal to the semiconductor mounting and matching assembly 10, and for providing an output signal from the assembly, which will be described in more detail in connection with the operation of the assembly 10.

The portion 16 of the housing is provided with an enlarged cylindrical opening 36 (FIG. 1) to form cylindrical wall 38. The opening 36 communicates externally at its right end of the housing 12 and is coaxially arranged with and opens into the opening 18 at its left end. The right end 21 of the center conductor 20 which is bifurcated, extends partially into the opening 36.

A transmission line 31 with sections providing an impedance matching network 80' schematically illustrated in FIG. 5, is provided by means received within the enlarged cylindrical opening 36 which will now be described in detail. A thin flat electrically conductive washer 40 with a central opening 42 is received within and in contact with the flat end wall 44 of the opening 36 of the housing 12. The center conductor 20 extends symmetrically through the opening 42 of the washer 40 to provide a short section of the line 31. A cup-shaped electrically conductive member 46 has an outer cylindrical side portion 47 which engages the periphery of the washer 40 and the inner surface 39 of the wall 38, and a radially extending bottom wall portion 48 which forms a cavity 51 within the member 46 to provide a relatively long section of the line 31. The member 46 also has a central opening 50 which receives therein in spaced relationship the end 21 of the center conductor 20, and provides another short section of the line 31.

A conductive cylindrical body 52 having an outer surface 53 which engages and makes good electrical contact with the inner surface 39 of the wall 38 of the housing 12, is removably received within the opening 36 with its flat left end surface 55 engaging and making good electrical contact with the wall portion 48 of the member 46. The body 52 has a central opening 54 extending therethrough which is differently dimensioned therealong to form three cylindrical cavities 56, 58 and 60 which are coaxial with the center conductor 20.

The innermost cylindrical cavity 56 of the body 52 has a smaller diameter than the inner cylindrical cavity 58, while the outer cylindrical cavity 60 has the greatest diameter. A thin conductive disc 62 is received within the cavity 58 of the body 52 proximate to the cavity 56 and has a cylindrical periphery engaging the inner cylindrical surface of the cavity 58 of the body 52. The disc 62 has a central opening 64 providing a short section of the transmission line 31 and is seated against the shoulder formed between the cavities 56 and 58 and hermetically sealed therewith. The disc 62 desirably may be made of a steel and cobalt alloy such as that commercially known as Kovar and hermetically sealed in place by brazing or other well known procedures. The bonding and sealing operation is desirably performed at a relatively high temperature such as above 705° C. with a solder material which may include silver, copper and indium, so that the disc 62 will not be displaced during subsequent operations bonding other components of the assembly.

The opening 64 through the body 62 is provided with a center conductor 68 which is supported by a glass to metal seal 70 provided by a suitable dielectric material secured within the central opening 64 of the disc 62. The conductor 68 extends coaxially through the openings 56 and 58 of the body 52 with its left end 71 being slideably received into the bifurcated right end 21 of the conductor 20 to make electrical contact therewith. The other end 72 of the center conductor 68 extends to and terminates at the boundary between the cavities 58 and 60. The body 52 at each of its cavities 56 and 58 also provides a respective relatively long section of the transmission line 31.

A conductive relatively thin circular terminating plate 74 with a central opening 75 is received within the cavity 60 of the opening 54 and secured to make good electrical contact with the body 52 at the shoulder provided between the cavities 58 and 60. The plate 74 may be gold plated to provide good electrical contact for terminating the leads of a semiconductor device 76. The semiconductor device 76 which may be a diode has an electrical connection at its base which is electrically secured at the tip of the end 72 of the center conductor 68 by soldering. The diode 76 is positioned centrally within the opening 75 of the terminating plate 74, and its connecting lead means such as the pair of wires 77 are electrically secured by a thermo-compression bond with the gold plated surface of the terminating plate 74 or by any other suitable means. The diode 76 is, thus, connected between the end 72 of the center conductor 68 and the plate 74 for mounting the diode 76 and terminating the end the transmission line 31.

The cavity 60 at the right end of the body 52 is enclosed by a flat circular plate 78. The plate 78 may be made of brass and secured with the body 52 by melting and fusing the plate therewith or by soldering. The diode 76, thus, is enclosed in a sealed chamber formed by the cavities 58 and 60 which may be evacuated or filled with a desired atmosphere. The body 52 may be readily detached by its movement to the right, whereby the left end 71 of its center conductor 68 is removed from the bifurcated end 21 of the center conductor 20. In this manner, the body 52, may be removed and another body 52 substituted therefor for easily replacing in the field a defective semiconductor device 76. The wall 38 of the portion 16 of the housing 12 is provided with a threaded outer surface for being threadily engaged by a cap 79. The cap 79 which may have therein a resilient spacer 81 is received over the open end of the portion 16 of the housing 12 for enclosing and securing the body 52 within the opening 36.

With the body 52 in place within the opening 36, a bias energization or signal may be delivered thereto through the high impedance connector 34 to provide the desired operating conditions for the diode 76. Radio frequency input signals delivered to the connector 24 are transmitted to the diode 76 over the coaxial conducting portion 23 and the impedance transforming coaxial line 31. Output signals from the diode 76, such as video signals resulting from the detection of the radio-frequency input signal, are transmitted back along the line 31 from the diode 76 toward the input connector 24 and may be derived at the high impedance connector 34 as an output from the semiconductor mounting and matching assembly 10.

The schematic diagram of FIG. 3 generally illustrates the impedance transforming network 80 of the coaxial line 31 embodied in the semiconductor mounting and matching assembly 10. In the particular embodiment described herein in detail, the semiconductor device 76 which is utilized is a video detector diode 82 of the Schottky type. However, the advantages of the invention are also achieved for mounting semiconductor mixers which may also be Schottky diodes, as well as attenuators, switches, phase shifters, and multipliers for which PIN diodes may be utilized. The diode 82 has a load resistance $R_L$ provided by its barrier resistance which for the embodiment described is 100 ohms. The pair of signal input terminals 84 of the network 80 provide an input impedance of 50 ohms for matching the characteristic impedance of the coaxial portion 23 of the assembly 10 and of a conventional coaxial line connected therewith at the connector 24 for feeding radio-frequency signals to the assembly 10. The impedance transforming network 80 operates to transform the input characteristic impedance $R_I$ of 50 ohms at the input end of the network 80 to the termination characteristic impedance at the other terminated end of the network which is equal to the 100 ohm load resistance $R_L$ of the diode 82.

Figure 4:
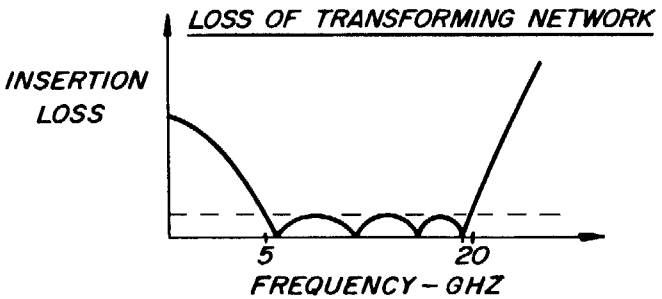

The network 80 of the assembly 10 is in the form of a double ordered transmission zero network described in detail in the article by Ralph Levy entitled "Synthesis Of Mixed Lumped And Distributed Impedance-Transforming Filters", IEEE, Transaction on Microwave Theory And Techniques, Volume MTT-20, No. 3, March 1972, pages 223 to 233. The network 80 is characterized by low insertion loss over a wide-band of frequencies which may be between 5 and 20 GHz as illustrated in FIG. 4. The network 80 is designed for the transformation of an input impedance $R_I$ of 50 ohms at one end, to a termination characteristic impedance $R_L$ of 100 ohms at its other end. Between the diode 82 and the input terminals 84, the network 80 is represented by a plurality of series connected inductive components 86, 88 and 90 shown in block form in FIG. 3, which are alternately arranged with shunt capacitive components 92, 94, 96 and 98. The schematically represented capacitive component 92 which is in parallel with the load resistance $R_L$ of diode 82, is provided by the junction capacitance of the diode 82. The inductive components 86 and 88 of the network 80 have an electrical length at the upper limit or cutoff frequency providing a phase shift $\theta$ of 60° while the inductive component 90 has a phase shift $\theta$ of 30°, and are reversed in order with respect to the input and output impedances of the network when compared with the network shown in FIG. 6 of the Levy article. This reversal is required to provide for an increase of impedance from the input to the output of the line 31, rather than the decrease treated in the illustrated networks of the article.

The inductive components 86, 88 and 90, and the capacitive components 94, 96 and 98 of the network 80 may be provided by appropriately dimensioned sections of a line transmitting the radio-frequency input signals principally in the TEM mode. Such a line includes the coaxial transmission line 31 of the assembly 10 which has relatively long sections for providing the inductive components 86, 88 and 90 with the desired electrical length. Short sections alternate with the relatively long sections and have closely positioned inner and outer conductors to provide the capacitive components 94, 96 and 98 of the network 80.

The values of the capacitive components 92, 94, 96 and 98 of the network 80, are given in Table VI of the Levy article for the admittance ratio R=2 for the impedance transformation from 100 to 50 as shown in the following Table 1.

TABLE 1

| Capacitor normalized susceptance - $C_{np}$ | |
|---|---|
| Component | Value |
| 92 | 1.1722 |
| 94 | 2.7630 |
| 96 | 3.6678 |
| 98 | 1.2070 |

Similarly Table VI provides the values for the inductive components 86, 88 and 90, shown in Table 2.

TABLE 2

| Line normalized susceptance - $Y_{np}$ | |
|---|---|
| Component | Value |
| 86 | 0.7867 |
| 88 | 0.9108 |
| 90 | 0.7930 |

The susceptances of the lumped shunt capacitances at $\theta$ equals 30° are calculated from the expression $$2\pi f_o Z_o C_n = C_{np} \tan 30°$$

where $f_o$=20 GHz, $Z_o$ is 100 ohms, and $C_n$ is the capacitance of the nth element normalized to the 100 ohm system.

With the substitution of the above values for normalized susceptance, the capacitance values of $C_n$ are provided as follows in Table 3.

TABLE 3

| Component | Value |
|---|---|
| 92 | 0.060 pf |
| 94 | 0.140 pf |
| 96 | 0.187 pf |
| 98 | 0.062 pf |

Since in applying Table VI of the Levy article, the value R is for the impedance transformation of 100 ohms source impedance to 50 ohms load resistance, the characteristic impedance of the network is assumed to be 100 ohms for the calculation of the network values, although the network is reversed in its actual usage. The impedance of the transmission line elements $Z_n$, normalized to the 100 ohms source impedance, is calculated from the following expression:

$$z_n = \frac{1}{Y_{np}} \times 100 \text{ ohms}$$

to yield from the above values of normalized susceptance $Y_{np}$, the following values in Table 4 for the inductive components of the network 80 of FIG. 3.

TABLE 4

| Component | Value |
|---|---|
| 86 | 127 ohms |
| 88 | 110 ohms |
| 90 | 126 ohms |

With the above derived values of the components of network 80 of FIG. 3, consideration will now be given to their implementation by the assembly 10 of FIGS. 1 and 2. For this purpose the network 80' of FIG. 5 is utilized since by its greater detail it takes into account the configurations and discontinuities of the several sections of the coaxial line 31 generally illustrated by the components of the network 80. The network 80' includes the parasitic properties of the diode 82 provided by its junction capacitance and the bonding inductance of its connecting lead means. For the purpose of the illustrated embodiment, the diode 82 is taken to have a capacitance in the order of 0.05 to 0.1 pf and bonding inductance of 0.1 nh. The provision of the seal 70 of dielectric material in the opening 64 of the disc 62 is also taken into account, in conjunction with the electrical properties provided by the configurations and discontinuities of the sections of the transmission line 31 between the input connector 24 and the diode 82 of the assembly 10.

Considering initially the diode 82 at the right end of the network 80' of FIG. 5, the load resistance $R_L$ of 100 ohms is connected across and terminates the network 80'. The junction capacitance 0.06 pf of the diode 82 providing the value of the component 92 of the network 80 of FIG. 3 is connected in parallel with its load resistance $R_L$. The bonding inductance 100 of the diode 82 provided by the connecting lead means 77 is in series with the load resistance $R_L$ of the diode 82.

The series connected inductive components 86' of the network 80' are provided by the cavity 58 in the body 52 which is 0.0916 inch long and has a diameter of 0.156 inch while the radius of the conductor 68 is 0.008 inch. In the embodiment described the impedance of the cavity is 136 ohms and is increased from the ideal value of 127 ohms which is shown in Table 4 in order to provide it with a diameter which is larger than that of the cavity 56. This allows the disc 62 to be received through the cavity 60, and to be seated against the shoulder formed between the cavities 56 and 58 for ease of assembly. The characteristic impedance of the cavity 58 when combined with the parasitic inductance of 0.1 nh associated with the diode bonding wires 77, results in a total value with a deviation from the specified value which is sufficiently small so that the assembly 10 still provides the desired performance. However, where desirable the cavity can be proportioned to provide with the inductance of the diode the total impedance value of 127 ohms specified in Table 4.

The capacitance 94 of the network 80 is the total equivalent capacitance provided by the capacitance of the short section of the transmission line 31 which is 0.0231 inch long and formed by the disc 62 within its opening 70 which has a radius of 0.050 inch, and the discontinuity capacitances developed at the transition interfaces between the relatively long sections of the transmission line 31 provided by the cavities 58 and 56. The capacitance of the disc 62 in picofarads per inch is given by the expression $$C_{62} = 0.614 \times 4.9/\log_{10}(b/a)$$

where "a" is the radius of the center conductor 68, and "b" is the radius of the opening 70 of the disc 62. The discontinuity capacitances are represented as capacitances 102 and 104 in FIG. 4. Their values are calculated in accordance with the article by J. R. Whinnery, et al. entitled "Coaxial Line Discontinuities," Proceedings of the I.R.E., Vol. 32, November 1949, pages 695 to 709. The configuration of the disc 62 also has its dimensions appropriately modified to take into account the effect of the dielectric material of the seal 70 and a disc capacitance of 0.128 pf which when combined with the capacitances of the components 102 and 104 results in the capacitance 94 of 0.140 pf desired for the network 80 in FIG. 3.

The short section of the transmission line provided by the disc 62 has an impedance of 33 ohms and its electrical length is about 40° at 20 GHz. The inductance, provided by the disc 62 is calculated from the expression $$L = Z_o(l/v),$$

where l equals the physical length, v equals the velocity of transmission, and $Z_o$ equals the characteristic impedance. This method of calculation is described in the article by G. Matthaei, L. Young, and E. Jones, entitled "Microwave Filters, Impedance-Matching Networks, And Coupling Structures", McGraw-Hill Book Co., New York, 1964, pages 360 to 370. The total inductance of 0.1446 nh is distributed on each side of the disc capacitance. Therefore, L/2 which equals 0.0723 nh requires the reduction in length of the cavity 58 by an amount equal to 0.0068 inch to provide the inductive component 86' so that an effective total impedance of 127 ohms with an electrical length of 60° at 20 GHz is provided for the component 86 of the network 80 in FIG. 3.

The inductive component 88 of the network 80 in FIG. 3 is provided in part by the cavity 56 of body 52 which is 0.0868 inch long and has a radius of 0.050 inch to form a relatively long section of the assembly 10. The cavity 56 provides the components 88' of the transmission line 31 shown in FIG. 5, with an inductive impedance of 109 ohms. The length of the cavity 56 is foreshortened to compensate for the adjacent inductances 87 and 89 provided at its right by the short section of disc 62 and at its left by the short section formed at the central opening 50 of the member 46, for the same reasons noted above in connection with inductive component 86'. Such foreshortening provides the required total impedance of 110 ohms for the inductive component 88 of the network 80 in FIG. 3.

The inductive impedance 89 provided by the short section of 0.0351 inch long and radius of 0.026 inch at the opening 50 of the member 46 is 24 ohms with its center conductor 20 having a radius of 0.017 inch, while the discontinuity capacitance 106 with the cavity 56 is 0.0235 pf and the discontinuity capacitance 108 with the cavity 51 is 0.0362 pf, giving a total capacitance value of 0.187 pf. Since the short section of the transmission line 31 provided at the opening 50 has a capacitance of 0.125 pf, its combination with the discontinuity capacitances 108 an 110 gives the desired total capacitance of 0.187 pf for the component 96 in the network 80 of FIG. 3.

The network 80 of FIG. 3 requires an impedance of 126 ohms for the inductive component 90 with an electrical length of 30° at 20 GHZ. To provide this impedance, the physical length of the cavity 51 provided by the member 46 is shortened to compensate for the effective inductance of the short section provided by the opening 50 of the member 46, and the inductance of the short section provided by the opening 42 in the washer 40 on the other side of the cavity 51. Taking this into account the component 90' required is provided by the relatively long section of cavity 51 having a physical length of 0.0458 inch and a radius of 0.140 inch.

The effective capacitance 98 of the network 80 of FIG. 3, is provided by the capacitance of the short section formed by the washer 40 and center conductor 20 and the discontinuity capacitances 110 and 112 derived from opposite sides of the washer 40. The fringing capacitances 110 and 112 can also calculated from the Whinnery et al article to provide in this case a total of 0.033 pf, which when combined with the capacitance of the washer 40 gives the desired value of 0.062 pf for the capacitance 98 of the network 80 in FIG. 3.

From the structure providing the transmission line 31 and its relationship to the components of the impedance transforming network 80' of FIG. 5, it is clear that the assembly 10 in effect provides the generally depicted components of the transforming network 80 of FIG. 3. The input impedance $R_I$ of 50 ohms is shown by dashed lines connecting the terminals 84 in the network 80' of FIG. 5 and represents termination of the network 80' by its characteristic impedance which is provided by the coaxial portion 23 and the characteristic impedance of the transmission means (not shown) joined therewith for providing input signals to the connector 24. Although the networks 80 and 80' are designed to transform an input impedance of 50 ohms to an output impedance of 100 ohms, it is apparent that the network may be designed to obtain other impedance transformations in the manner described herein. The dimensions and configurations of the sections providing the transmission line 31 of the assembly 10, may also be appropriately modified for the purpose of achieving the desired results for different design requirements.

The network 31 may also be modified to accommodate semiconductor devices 76 with different characteristics for achieving the advantages of the invention. FIG. 6 discloses the return loss characteristic over a range of frequencies up to 20 GHz for semiconductor mounting and matching assemblies embodying the invention and incorporating diodes with different junction capacities, since this parameter is the least controllable of the assembly 10. Thus, the curve A of FIG. 6 illustrates the return loss characteristic of an assembly 10 including a diode having a junction capacitance of 0.08 pf, a barrier resistance of 100 ohms, and a bonding inductance of 0.1 nh. The return loss shown over the frequency range of 0.2 to 20 GHz has a low value representing low reflection and attentuation of input signals over a wide-band of frequencies. The return loss of curve A corresponds to a voltage standing wave ratio (VSWR) of less than 1.5 to 1 over the frequency range of 6 to 20 GHz. This is a much lower value than that which is currently achieved by state of the art devices, which typically provide voltage standing wave ratios of approximately 2.5 to 1. Similar superior results are shown by curve B for an assembly 10 incorporating a diode 76 with a junction capacitance of 0.09 pf and with the resistive, and bonding inductance properties provided by the diode of the curve A, while curve C is for an assembly 10 with such a diode 76 with a junction capacitance of 0.07 pf. The assembly 10 described herein, thus, provides voltage standing wave ratios of less than 2 to 1 for frequencies extending beyond 18 GHz, while its performance over a considerable portion of the wide-band of frequencies, is substantially better than 1.2 to 1. The invention as illustrated is able to simultaneously achieve, as a practical matter, low reflection and attenuation of input signals and high operating or tangential sensitivity. The performance illustrated by the curves of FIG. 6, may also be obtained when the semiconductor mounting and matching assembly 10 incorporates semiconductor devices for providing mixers, phase shifters, attenuators, switches, and multipliers as noted above.

The structure of the assembly 10 permits, in the event of a failure of a semiconductor device, the replacement of its semiconductor device in the field without deterioration of the desirable operating characteristics of the assembly. Such semiconductor device replacement does not require tuning of the structure in order to retain the same high performance, and the semiconductor device remains hermetically sealed. The removable portion of the assembly embodying the hermetically sealed semiconductor device includes a portion of the impedance transforming network, which also assures the proper matching of the network with the semiconductor device. Since the transforming network incorporates the parasitic elements of the semiconductor device, they are utilized as part of the network to avoid the detrimental effects which have limited prior art devices. The transforming network also allows sufficient variation in the structure of the assembly 10 to increase the ease of fabrication. This allows the manufacture of the assembly 10 of the invention at a lower cost, while still providing its superior operating performance and its other advantages.

It will, of course, be understood that the description and drawing herein contained, are illustrative, merely, and that various modifications of changes may be made in the structure disclosed without departing from the spirit of the invention.

What is claimed is:

1. A semiconductor mounting and matching assembly comprising a radio-frequency transmission line operating principally in the TEM mode having a first end for receiving radio-frequency signals with a given first characteristic impedance, a second end with a second characteristic impedance, and a plurality of sections between its first and second ends having configurations and discontinuities providing reactive elements, a semiconductor device mounted at the second end of the transmission line having an impedance which differs from the first characteristic impedance of the transmission line and providing a load resistance terminating the transmission line at its second end, and a network which transforms the impedance between the first and second ends of the transmission line and matches the load resistance of the semiconductor device to the first characteristic impedance comprising the reactive elements provided by the sections of the transmission line and the capacitive and inductive reactance properties provided respectively by the junction capacitance and connecting lead means of the semiconductor device at the second end of the transmission line, the reactive elements of the transmission line at its second end accommodating the reactance properties of the semiconductor device so that the network incorporates therein the reactance properties of the semiconductor device and such reactance properties are not an effective part of the load terminating the transmission line at its second end, whereby said assembly transmits radio-frequency signals from its input end to the semiconductor device at its second end with low reflection and attenuation over a wide-band of frequencies.

2. The assembly of claim 1 in which the semiconductor device has a load resistance which differs from the first characteristic impedance of the transmission line, and the network of the transmission line transforms the first characteristic impedance of the first end of the transmission line to a value at its second end which matches the load resistance of the semiconductor device.

3. The assembly of claim 2 in which the load resistance of the semiconductor device is greater than the first characteristic impedance of the transmission line.

4. The assembly of claim 3 in which the load resistance of the semiconductor device is approximately twice as great as the first characteristic impedance of the transmission line.

5. The assembly of claim 4 in which the load resistance of the semiconductor device is approximately 100 ohms and the input characteristic impedance of the transmission line is approximately 50 ohms.

6. The assembly of claim 1, 2, 3, 4 or 5 in which the semiconductor device is a diode with its load resistance provided by the diode barrier resistance, and its capacitive and inductive properties provided respectively by the junction capacitance and connecting lead means.

7. The assembly of claim 1 in which the network of elements effectively provides a plurality of series connected inductive components interconnected with shunt capacitive components with the capacitive property of the semiconductor device providing a capacitive component of the network at the second end of the transmission line and the inductive property of the semiconductor device being utilized for providing an inductive component at the second end of the transmission line for thereby incorporating into the network the reactive properties of the semiconductor device.

8. The assembly of claim 7 in which the network is a low pass L-C type which transforms the first characteristic impedance of the transmission line to a higher second characteristic impedance at its second end to match the load resistance of the semiconductor device.

9. The assembly of claim 7 in which the semiconductor device is a diode with its load resistance provided by the diode barrier resistance and its capacitive and inductive properties provided respectively by the junction capacitance and connecting lead means.

10. The assembly of claim 1, 2, 3, 4, 5, 7, 8 or 9 in which the transmission line is a coaxial line having outer and inner conductors, the outer conductor between the first and second ends of the transmission line being dimensioned for providing the respective sections of the transmission line, and includes connecting means for providing radio-frequency signals and a bias signal to the first end of the transmission line for delivery to the semiconductor device, and said semiconductor device provides an output signal transmitted over the transmission line for being delivered by the connecting means.

11. The assembly of claim 7 in which the transmission line is a coaxial line having outer and inner conductors, the outer conductor being dimensioned for providing along the transmission line relatively long transmission line sections alternating with relatively short sections, the short sections having the outer conductor closely spaced to the inner conductor to provide low impedance and effectively lumped shunt capacitive components of the network while the relatively long sections have the outer conductor less closely spaced to the inner conductor to provide a higher impedance and effectively the series inductive components of the network.

12. The assembly of claim 11 in which the section at the first end of the transmission line provides a capacitive component and the section at the second end of the transmission line provides an inductive component which is adjusted for including the inductive property of the semiconductor device.

13. The assembly of claim 7 which includes closure means hermetically sealing the semiconductor device within the transmission line at its second end.

14. The assembly of claim 13 in which the closure means includes an end member at the second end of the transmission line and a wall of dielectric material within a section of the transmission line to provide a sealed chamber within which the semiconductor device is hermetically enclosed.

15. The assembly of claim 14 in which the transmission line is a coaxial line having outer and inner conductors, the outer conductor between the first and second ends of the transmission line being dimensioned for providing the respective sections of the transmission line, with relatively long sections alternating with relatively short sections to provide the transmission line, the short sections having the outer conductor closely spaced to the inner conductor to provide low impedance and effectively lumped shunt capacitive components of the network while the relatively long sections have the outer conductor less closely spaced to the inner conductor to provide a higher impedance and effectively the series inductive components of the network, the dielectric wall of the closure means extends between the outer conductor and the inner conductor of a short section of the transmission line to provide the sealed chamber and the configuration of the outer conductor is adjusted for the effect of the dielectric material of the wall in providing one of the capacitive components of the network.

16. The assembly of claim 15 in which the chamber includes the cavity provided by a long section which is enclosed at one end by the dielectric wall in the short section of the transmission line and which section has the semiconductor device at its other end.

17. The assembly of claim 16 in which the assembly has first and second detachably secured and interengaged portions, the first portion includes the first end of the transmission line while the second portion includes the second end of the transmission line and the semiconductor device, and the second portion is detachable from the first portion while the semiconductor device is hermetically sealed therewithin.

18. The assembly of claim 17 in which the inner conductor of the second portion is positioned and secured by the dielectric wall and extends outwardly for electrically engaging the inner conductor of the first portion when the portions are interengaged.

19. The assembly of claim 18 in which the semiconductor device is a diode, and the first portion of the assembly includes connecting means for providing radio-frequency signals to the first end of the transmission line, for delivering a bias signal to the diode, and for receiving output signals provided by the semiconductor device.

20. A semiconductor mounting and matching assembly comprising a coaxial transmission line having a first end for receiving radio-frequency signals and providing an input impedance, a second end having a second characteristic impedance, and a plurality of sections between its first and second ends having configurations and discontinuities providing reactive elements, a semiconductor diode mounted at the second end of the transmission line having an impedance which differs from the input impedance of the first end of the transmission line and including a load resistance terminating the transmission line at its second end, and a network which transforms the impedance between the first and second ends of the transmission line and matches the load resistance of the semiconductor diode to the input impedance comprising the reactive elements provided by the sections of the transmission line and the capacitive and inductive reactance properties provided respectively by the junction capacitance and connecting lead means of the semiconductor diode at the second end of the transmission line, the reactive elements of the transmission line at its second end accommodating the reactance properties of the semiconductor diode so that the network incorporates therein the reactance properties of the semiconductor diode and such reactance properties are not an effective part of the load terminating the transmission line, whereby said assembly transmits radio-frequency signals from its input end to the semiconductor device at its output end with low reflection and attenuation over a wide-band of frequencies.

21. The assembly of claim 20 in which the transmission line has outer and inner conductors, the outer conductor being dimensioned for providing along the transmission line relatively long sections alternating with relatively short sections, the short sections having the outer conductor closely spaced to the inner conductor to provide low impedance and effectively lumped shunt capacitive components of the network while the relatively long sections have the outer conductor less closely spaced to the inner conductor to provide a higher impedance and effectively series inductive components of the network.

22. The assembly of claim 21 in which at least a portion of the outer conductor of the transmission line is provided by a conductive body with an opening therethrough providing a plurality of at least two cylindrical cavities including an outer cavity beyond the second end of the transmission line and an inner cavity adjacent to the outer cavity providing a relatively long section at the second end of the transmission line, the outer cavity has a greater diameter than the inner cavity and the inner cavity provides a series inductive component of the network at the second end of the transmission line, and includes a relatively thin conductive disc with a central opening therethrough transversely positioned within the inner cavity of the body to provide a relatively short section between relatively long sections of the transmission line.

23. The assembly of claim 22 which includes a conductive termination plate with a central opening received within the outer cavity of the body proximate to the inner cavity, and the diode is positioned within the opening of the plate and has a base mounted on and electrically connected with the end of the inner conductor at the second end of the transmission line and connecting lead means electrically joining the diode with the plate for terminating the transmission line.

24. The assembly of claim 23 which includes closure means having a conductive end member enclosing the outer cavity of the body and a wall of dielectric material within the central opening of the disc and extending between the outer and inner conductors to provide a sealed chamber within the inner and outer cavities of the body and hermetically enclosing therein the semiconductor diode, the configuration of the outer conductor being adjusted for the effect of the dielectric material of the wall in providing one of the capacitive components of the network.

25. The assembly of claim 24 in which the assembly has first and second detachably secured and interengaged portions, the first portion includes the first end of the transmission line and the second portion includes the second end of the transmission line, the body with its closure means and the diode, and the second portion is detachable from the first portion while the diode is hermetically enclosed therewithin.

26. The assembly of claim 25 in which the inner conductor of the second portion is positioned and secured by the dielectric wall and extends outwardly for electrically engaging the inner conductor of the first portion when the portions are interengaged.

27. The assembly of claim 26 in which the first portion of the assembly includes connecting means for providing radio-frequency signals to the first end of the transmission line, for delivering a bias signal to the diode, and for receiving output signals provided by the diode.

28. The assembly of claim 27 in which a relatively short section at the first end of the transmission line provides a capacitive component and the relatively long section at the second end of the transmission line provides an inductive component which is adjusted for including the inductive property of the diode.

29. The assembly of claim 28 in which the network is a low pass L-C type which transforms the input impedance of the transmission line to a higher second characteristic impedance at its second end to match the load resistance of the diode.

30. The assembly of claim 29 in which the load resistance of the diode is provided by its barrier resistance, its capacitive property is provided by its junction capacitance and its inductive property is provided by its connecting lead means, and the capacitive property provides a parallel capacitive component at the second end of the transmission line.

* * * * *